US006105162A

United States Patent [19]

Douglas et al.

[11] Patent Number: 6,105,162

[45] Date of Patent: Aug. 22, 2000

[54] HAND PROTECTOR

[75] Inventors: Jeffrey D. Douglas; Rogers W. Douglas, Jr.; Rafael C. Ramos, all of Houston, Tex.; D. Martin Cothern, Jacksonville, Fla.

[73] Assignee: Douglas Protective Equipment, Inc., Houston, Tex.

[21] Appl. No.: 08/706,845

[22] Filed: Sep. 3, 1996

[51] Int. Cl.[7] ..... A41D 13/10

[52] U.S. Cl. ..... 2/20; 2/161.1

[58] Field of Search ..... 2/16, 19, 20, 159, 2/160, 161.1

[56] References Cited

U.S. PATENT DOCUMENTS

| | | | |
|---|---|---|---|
| 3,991,420 | 11/1976 | Savarino | 2/16 |
| 4,042,975 | 8/1977 | Elliot, Jr. et al. | 2/19 |
| 4,411,024 | 10/1983 | Hayes | 2/20 |
| 4,484,359 | 11/1984 | Tirinen | 2/20 |
| 4,556,992 | 12/1985 | Drury | 2/20 |
| 4,570,269 | 2/1986 | Berlese | 2/20 |
| 4,599,747 | 7/1986 | Robinson | 2/20 |
| 4,700,405 | 10/1987 | Sternberg | 2/19 |
| 5,511,242 | 4/1996 | Bianchi | 2/16 |
| 5,640,712 | 6/1997 | Hansen et al. | 2/20 |
| 5,898,938 | 5/1999 | Baylor et al. | 2/20 |

*Primary Examiner*—Michael A. Neas

*Attorney, Agent, or Firm*—William D. Jackson; Locke Liddell & Sapp LLP

[57] ABSTRACT

Hand protection systems for use with batting gloves having a back surface which is adapted to fit over the metacarpal portion of the wearer's hand for protecting the hand. The components of the protective system can be releasibly connected to the glove while in place on the wearer's hand. The system involves a cushioning pad which is releasibly connected at its underside to the back surface of the glove so that it is held firmly in place on the glove while at the same time it being readily withdrawn from the glove. A rigid plate member is releasibly secured to the outer side of the cushioning pad so that a sharp blow to the outer surface of the plate member is distributed to a substantial surface area of the pad. The plate member has at least one transversely extending rib eccentrically positioned on the plate member along its longitudinal dimension. A second rib may be spaced from and generally co-extend with the first rib member. The cushioning pad may be configured to provide a reduced interior standoff section and an annular cushioning section. The rib plate member may be of an arcuate shape generally conforming to the convex shape of the outer side of the cushioning pad and can be provided with a downwardly extending lip portion which is adapted to fit around the outer edge of the protective pad.

18 Claims, 2 Drawing Sheets

HAND PROTECTOR

FIELD OF THE INVENTION

This invention relates to hand protection and more particularly to protective glove systems for protecting the back of the wearer's hand.

BACKGROUND OF THE INVENTION

In various sporting events, as well as in other endeavors, it is commonplace for the participants to wear specialized gloves on their hands. Such gloves are worn for a number of reasons. In sports, such as hockey and football, the gloves are worn for the purpose of protecting the wearer from injury as well as to facilitate athletic performance. For example, a football player might wear gloves on both hands in order to facilitate catching and handling the football, as well as to offer some protection. In other sports, such as hockey, the gloves may be heavily padded to offer protection from injury.

In other endeavors, such as golf and baseball, the participant may wear gloves on one or both hands in order to facilitate performance; to enable the wearer to effectively grip the shaft of a golf club or the handle of a baseball or softball bat. These gloves are normally made at least partially of a soft leather which fits the hand in a closely-conforming relationship so as to facilitate the wearer's gripping of the bat handle or golf shaft, as the case may be. In baseball and softball, a player's glove offers a "platform" for protective means which may be worn on one or both hands to protect the batsman against injury or reinjury to the hand. The back of the hand facing the pitcher (the left hand in the case of a right-handed batter) is particularly vulnerable to injury. Bruises and fractures of the hand, due to the hand being hit by a pitched ball, can be sustained on the metacarpal portion of the hand, generally defined as the back of the hand ranging from the knuckles (metacarpophalangeal joints) down to the wrist joint.

U.S. Pat. No. 4,042,975 to Elliott et al discloses a protective system for athletes, such as baseball players, in which a pair of protective plates are releasibly attached to the back side of a batting glove. The upper plate is segmented along one end to facilitate protection of the knuckles and fingers, and the lower plate is of a generally rectilinear or rectangular shape. The protective plates are releasibly secured to the back of the glove by suitable means such as thistle cloth material, commonly referred to as Velcro, by fitting the plates into protective pockets, or through the use of mating, snap fasteners. The lower protective plate, which in transverse end view is of a convex arch shape, incorporates a layer of shock-absorbing cushioning such as is provided by a resilient, polyurethane foam secured to the underside of the plate by an adhesive. The Velcro fastening material used to secure the plate to the glove is, in turn, secured to the underside of the cushioning material by a second layer of adhesive material. The plate is curved, as noted above, so that it projects around the edge of the hand on which the glove is fitted.

SUMMARY OF THE INVENTION

In accordance with the present invention, there are provided new hand protection systems for use with gloves, such as batting gloves and the like, which are used in protecting the wearer's hand and which have a back surface which is adapted to fit over the metacarpal portion of the wearer's hand. The several components involved in forming the protective system can be releasibly connected to the glove while in place on the wearer's hand. The invention involves a cushioning pad which is releasibly connected at its underside to the back surface of the glove. The cushioning pad is positioned to cover a substantial portion of the metacarpal portion of the wearer's hand. The releasible connection permits the pad to be held firmly in place on the glove while at the same time permitting it to be readily withdrawn from the glove. A rigid plate member is releasibly secured to the outer side of the cushioning pad and is configured to cover a substantial portion of the cushioning pad. The plate member can be easily removed from the pad, but is also held firmly in place. The relationship between the pad and the plate member is such that a sharp blow to the outer surface of the plate member is distributed to a substantial surface area of the cushioning pad. In a preferred embodiment of the invention, the plate member has at least one transversely extending rib upstanding from the outer surface of the plate member. More preferably, the rib is eccentrically positioned on the plate member along its longitudinal dimension. The plate member may be provided with a second rib which is spaced from and generally co-extends with the first rib member.

In a further aspect of the invention, the cushioning pad is configured in a manner to provide a reduced interior standoff section and an annular cushioning section surrounding the interior standoff section. A blow to the protective plate is thus distributed in the pad through its annular section. The interior standoff section may take the form of a "donut hole" within the pad, or the reduced section may take the form of a relatively thin intermediate layer of the pad so that it is less subject to distortion than if a hole extends through the pad.

Preferably, the releasible connections between the cushioning pad and the back surface of the glove, and the outer side of the cushioning pad and the underside of the protective plate, are provided by mating thistle cloth connectors, such as those available under the designation of Velcro. Further, the cushioning pad incorporates an compressive core material comprised of an open cellular foam material having air permeability. The surrounding covering material of the pad encapsulates the core material and likewise is permeable to permit the flow of air from the core material through the covering material. The interconnecting Velcro strips on the underside of the plate member and the outer surface of the pad covering material likewise accommodate air flow through the covering material and the interior air-permeable foam material.

In yet a further embodiment of the invention, the rib plate member, which is of an arcuate shape generally conforming to the convex shape of the outer side of the cushioning pad, is provided with a downwardly extending lip portion which is adapted to fit around the outer edge of the protective pad when the plate member is in place on the pad member. The underside of the pad member, which fits directly over the glove, is generally flat or only slightly convex; in any case, having a convex curvature which is less than the convex curvature of the outer surface of the pad.

DETAILED DESCRIPTION OF THE INVENTION

Figure 1:
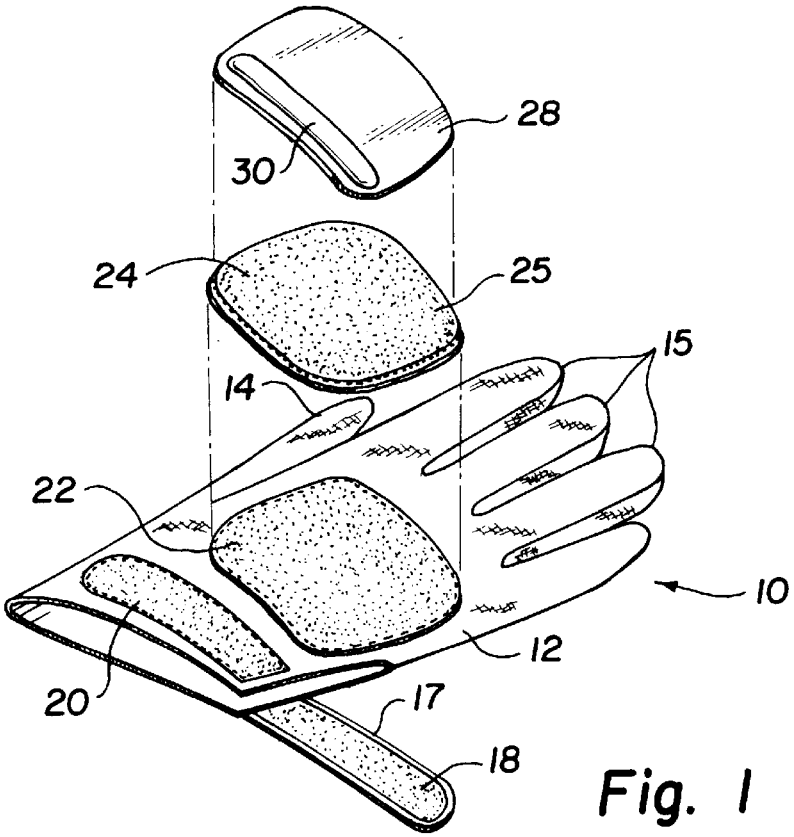
FIG. 1 is an exploded view showing a batting glove with component protective parts in accordance with one embodiment of the present invention.

Turning first to FIG. 1, there is illustrated an exploded view of a batter's glove along with associated component protective parts which are releasibly connected to one another in a manner in which they can be individually interchanged to meet the needs of a particular situation. More particularly there is shown in FIG. 1 a batting glove 10 having a body portion 12 and associated thumb and finger segments 14 and 15, respectively. The base of the glove is provided with a wrist pad 17 which can be used to secure the glove in place on the wearer's hand. By way of example, the wrist tab may be tightened and secured in place on the wearer's hand by the use of cooperative thistle cloth fastening materials of the type commonly designated by the mark Velcro and referred to as such hereinafter. Thus, the wrist tab is provided on its under surface with a Velcro hook component 18 which is adapted to be engaged and held in place by a complimentary strip of Velcro loop material 20, which will be well understood by those skilled in the art. The pile or hook material 18 readily engages the loop material 20 in a manner that the wrist tab can be tightened to hold the glove in place and easily removed when the wearer wishes to remove the glove.

The back surface of the glove is provided with a Velcro hook or pile material 22 in order to support a cushioning pad 24 on the back of the glove. The Velcro strip 22 covers a substantial portion of the metacarpal portion of the wearer's hand so the cushioning pad, when in place, likewise provides protection over a substantial portion of the metacarpal area of the hand. The protective pad 24 (shown in exploded view with respect to the glove) is provided with Velcro loop material (not shown) on the bottom of the pad, and the upper portion of the pad is provided with Velcro pile material 25. Shown in exploded view above the pad 24 is a protective plate 28 formed of a rigid plastic material. The plastic plate member 28 preferably has at least one eccentric rib 30 extending transversely of the plate member. As described below, the protective plate may comprise a plurality of such rib sections. However, when only one rib is provided, the eccentric location of the rib, in closer proximity to one edge of the plate than the other, permits the plate to be positioned so that the rib is in a desired portion of the wearer's hand. For example, in the relationship shown in FIG. 1, the rib will extend over the lower portion of the metacarpal section of the hand relatively close to the wrist. By simply turning the plate member around so that the writing on the plate member is upside down, the rib member will be in a closer location to the metacarpal phalangeal joints of the hand. As described below, in one embodiment of the invention, the protective plate is provided with a subtending lip portion, and in this embodiment, preferably the plate member will take a form in which there are two more or less parallel co-extending ribs.

The outer surface 32 of the protective pad 24, which is generally concave to conform to the arched shape of the plate member 28, is provided with Velcro pile material 33. The underside of the plate is likewise provided with Velcro loop material which is used to releasibly secure the plate to the outer surface 32 of the pad member.

Preferably, the pad member is formed of an interior compressive core material taking the form of an open cellular foam material, such as may be formed of such flexible polymers as provided by polyurethane, rubber latex, polyethylene, or various vinyl aromatic polymers. Such foam plastics are characterized as open cellular in the sense that the void cells within the foam are interconnected in a manner to provide air permeability within the foam. That is, air is not trapped within the void cells of the foam material but may flow into or out of the interior core material. The surrounding covering material, which takes the form of loop-type Velcro on the bottom and pile-type Velcro on the top, is likewise permeable to air flow.

Figure 2:
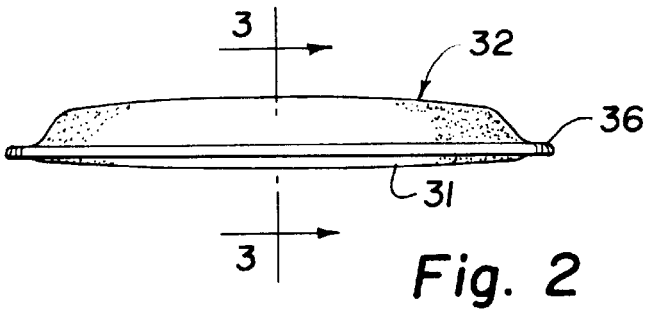
FIG. 2 is a side elevational view of the protective pad shown in FIG. 1.

FIG. 2 is a side elevational view of the cushioning pad showing the preferred relative configurations of the underside 31 and the outerside 32 of the pad. The underside 31 is relatively flat, although it can be curved somewhat as it meets the surrounding bead section 36 of the covering material. The outerside covering material has a more definite convex curvature which is greater than the curvature of the underside. Stated otherwise, when viewed from the side elevational perspective of FIG. 2, the overall radius of curvature of the outer side of the pad will be substantially less than the radius of curvature, if any, of the underside of the protective cushioning pad member.

Figure 3:
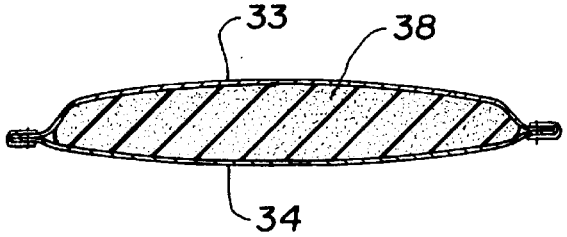
FIG. 3 is a transverse sectional view of the protective pad of FIG. 2.

FIG. 3 is a transverse sectional view of the pad of FIG. 2 taken along line 3—3 and showing the interior open cellular core material 38 and the outer covering materials 33 and 34. The pile-type configuration of the Velcro strip 33, when contacted by the loop-type Velcro fastening material on the underside of the protective plate 28, is such as to still permit air flow through the covering material into the interior core material. This arrangement provides an "air cushion" over the metacarpal portion of the hand so that a sharp blow to the protective rigid plate member, which is transferred to the underlying cushioning pad, is accompanied by air flow through the foam core material 38.

Figure 4:
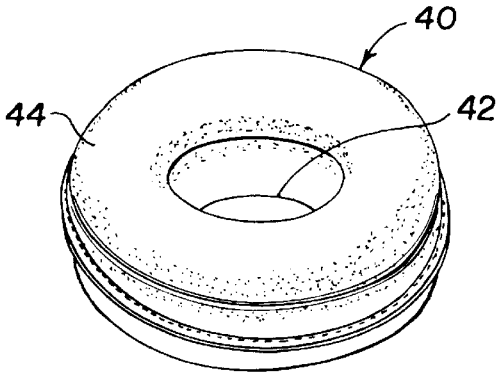
FIG. 4 is a perspective view of a modified form of protective pad.

FIG. 4 is perspective view of a modified form of cushioning pad 40 which is particularly adapted to be worn to protect a bone fracture or bad bruise in the interior metacarpal portion of the hand. Here, the pad is configured in a manner to provide a reduced interior standoff section 42 which is adapted to be positioned over the area of the hand of particular stress. In this case, the standoff section 42 of the pad is provided by a "donut hole" in the middle of the cushion with the remaining portion of the pad defining an annular cushioning section 44 extending around the interior hole 42. Here, it will be recognized that a blow to the rib plate member is transferred to the cushioning pad member in a manner so that it is distributed in the pad through the annular section 44.

Figure 5:
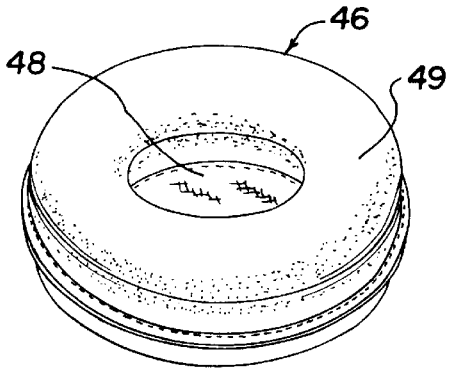
FIG. 5 is a perspective view of another modified form of protective pad.

FIG. 5 illustrates yet another embodiment of the invention in which the interior standoff section of a pad 46 is provided with a "web" portion 48 rather than being completely open. Here, the function of the pad member is very similar to that shown in the "donut hole" configuration of FIG. 4, except that the web will be placed in tension on the overlying plate member tending to keep the annular section 49 of the cushioning member in place. This embodiment can be best understood by reference to FIG. 6, which is a side-elevation sectional view of a pad 46 of the type shown in FIG. 5 with an overlying protective plate 50 in place. The annular core of the pad 46 is formed of an open-cell plastic foam 52, similar to the material as described above with reference to FIG. 3. The covering material 54 on the underside of the pad 46 incorporates a loop-type Velcro fastening material, and the covering material 55 on the upper side of the pad incorporates a pile-type Velcro fastening material, similarly as described above. Bead 57 is provided around the outer periphery of the annular ring in order to fasten the two materials together. The interior web 48 can be formed by simply fastening the upper and lower covering materials together through the use of suitable adhesives or by stitching or the like. Here, a glancing blow to the plate member along a line of force indicated by arrow 60 will necessarily tend to exert a somewhat distorting force on the annular pad member 46. This will produce a reaction at the engaging Velcro material connecting pad 46 at the bottom of the annular section and the back side of the glove (not shown). In addition, the intermediate web section 48 will be placed in tension somewhat thereby resisting distortion of the pad member.

Figure 7:
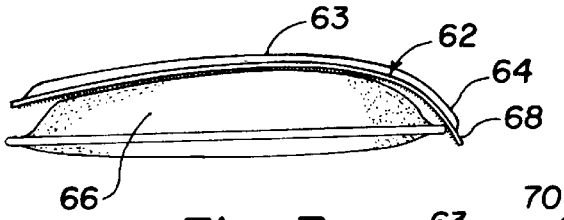
FIG. 7 is a side elevational view of a modified form of protective plate for use in the present invention.

FIG. 7 illustrates yet another body of the present invention in which a protective plate member 62 incorporates a transverse main section 63 and is provided with a downwardly-extending lip portion 64 which is adapted to fit around the outer surface of the underlying cushioning pad 66 and also around the edge of the wearer's hand (not shown). That is, the lip member 64 extends slightly past the pad member 66 to provide a depending terminal section 68 which can be in proximity to or in actual engagement with the outer edge of the glove fitting around the wearer's hand. In this embodiment of the invention, the protective plate member cannot be reversed, as described above, with reference to FIG. 1. Here, it is preferred that the plate member be provided with two co-extending rib members as described below in order to strengthen the plate member and also to function to aid in evenly distributing force applied to the outer surface of the plate member throughout the underlying cushioning pad. As shown in FIG. 7, the lip member 64 extends downwardly from the transverse portion 63 of the plate member through a radius of curvature which is substantially less than the radius of curvature of the major transverse portion of the plate member. That is, the average curvation of the transverse portion is less than the curvature of the lip member at it curves downwardly. Preferably, the lip member 64 defines with the transverse portion 63 of the plate member at an angle approaching 90°–100° and preferably less than 120° as shown.

Figure 6:
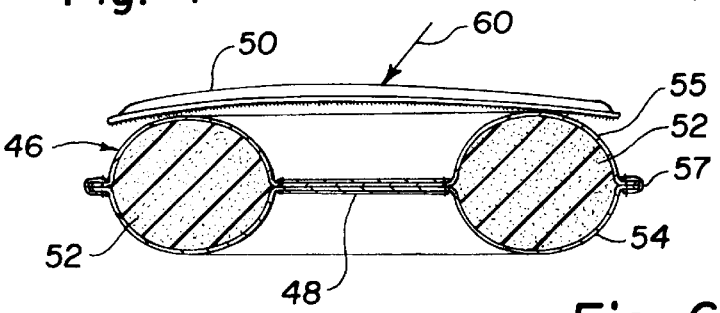
FIG. 6 is a side sectional view of a protective plate and the protective pad of FIG. 5.
Figure 8:
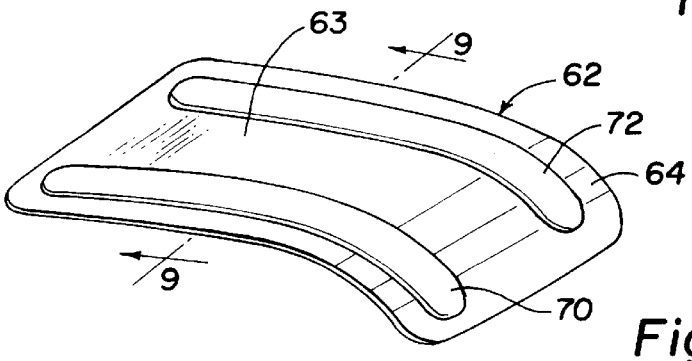
FIG. 8 is a perspective view of a modified form of a protective plate.

FIG. 8 is a perspective view of the plate of FIG. 6. As shown there, the protective plate 62 is provided with two co-extending ribs 70 and 72, which are generally parallel to one another and generally co-extensive with one another. Because of the nature of the downwardly-extending lip, the protective plate cannot be reversed to put a single rib over the upper or lower portion of the hand at the discretion of the wearer. Here, the two co-extensive ribs generally extend over the area of the hand protected by the plate and, in addition, provide an additional strengthening to the plate member. Preferably, the ribs extend over the transverse portion 63 of the protective plate and onto the downwardly projecting lip member 64, thus providing additional strength at this portion of the protective plate.

Figure 9:
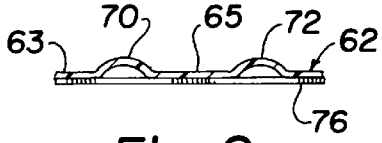
FIG. 9 is a transverse sectional view taken along line 9—9 of FIG. 8.

FIG. 9 is a transverse sectional view taken along line 9—9 of FIG. 8 and showing details of the rib configuration in the protective plate. As shown in FIG. 9, the ribs 70 and 72 are formed by arch-type projections which, on the underside of the plate, form concave cavities projecting upwardly from the flattened section 65 of the plate. The ribs provide generally longitudinal structures which, when viewed from the upper side of the plate, provide convexing configurations. The underside of the protective plate 62 is provided with a covering of Velcro loop material 76 which is secured to the underside of the plate by any suitable adhesive (not shown.). As noted previously, the ribbed configuration of the protective plate provides an added measure of protection over that which would be offered by a plate without such rib configurations. The ribs tend to strengthen the plate so that it is less likely to be ruptured by a hard blow. In addition, the arch-shaped configuration of the ribs tends to distribute force stresses throughout the plate rather than allowing them to remain localized. Thus, a sharp blow at the apex of one of ribs 70 and 72 will tend to be distributed down and outwardly through the ribs to the flattened portion of the plate and then, of course, to the underlying cushioning pad.

Having described specific embodiments of the present invention, it will be understood that modifications thereof may be suggested to those skilled in the art, and it is intended to cover all such modifications as fall within the scope of the appended claims.

What is claimed:

1. In a glove for use in protecting the wearer's hand and having a back surface adapted to fit over the metacarpal portion of the wearer's hand, the combination comprising:

a. a cushioning pad releasably connected at its underside to the back surface of the glove and positioned to cover a portion of the metacarpal portion of the wearer's hand, said cushion being releasably connected to the back surface of said glove in a manner permitting the cushion to be held firmly in place on the glove; and b. a rigid plate member releasably secured to the outer side of said cushion pad, said plate member configured to cover a substantial portion of said cushioning pad whereby a sharp blow to the outer surface of said plate member is distributed to a substantial surface area of said cushioning pad, wherein said cushioning pad is configured in a manner to provide a reduced interior standoff section and an annular cushioning section surrounding said interior section whereby a blow to said plate member is distributed in said pad through said annular section.

2. In a glove for use in protecting the wearer's hand and having a back surface adapted to fit over the metacarpal portion of the wearer's hand, the combination comprising:

a. a cushioning pad releasably connected at its underside to the back surface of the glove and positioned to cover a portion of the metacarpal portion of the wearer's hand, said cushion being releasably connected to the back surface of said glove in a manner permitting the cushion to be held firmly in place on the glove, wherein said cushioning pad is configured to provide a cushioning pad having a transverse elevational configuration in which the underside surface of said cushioning pad is relatively flat in relationship to the outer surface of said cushioning pad, said outer surface having a convex curvature which is greater than the surface of the underside surface; and b. a rigid plate member releasably secured to the outer side of said cushion pad, said plate member configured to cover a substantial portion of said cushioning pad whereby a sharp blow to the outer surface of said plate member is distributed to a substantial surface area of said cushioning pad.

3. In a glove for use in protecting the wearer's hand and having a back surface adapted to fit over the metacarpal portion of the wearer's hand, the combination comprising:

a. a cushioning pad releasably connected to the back surface of the glove and positioned to cover at least a portion of the metacarpal portion of the wearer's hand, said cushioning pad comprising an interior compressive core material comprised of an open cellular foam material having air permeability and a surrounding covering material encapsulating said core material and having air permeability to permit the flow of air from said core material through said covering material;

b. a rigid plate member disposed on the outer side of said cushioning pad and configured to cover a substantial portion of said cushioning pad whereby a sharp blow to the outer surface of said plate member is distributed to a substantial surface area of said cushioning pad; and c. means releasably connecting the underside of said plate member to the outer side of covering material of said cushioning pad covering material in a manner to permit air flow through the outer layer of said cushioning pad into said interior core material when said rigid plate member is in place.

4. The combination of claim 3 wherein the outer side of said cushioning pad is secured to the under surface of said plate member by mating thistle cloth connectors secured respectively to the outer side of said pad and under surface of said plate.

5. The combination of claim 4 wherein said plate member has at least one upstanding rib extending transversely of said plate member.

6. The combination of claim 5 wherein said rib is eccentrically positioned on said plate member along the longitudinal dimension thereof.

7. The combination of claim 6 wherein said plate member terminates in a downwardly extending lip portion that fits around the outer edge of said cushioning pad.

8. The combination of claim 3 wherein said cushioning pad is configured in a manner to provide a reduced interior standoff section and an annular cushioning section surrounding said interior section whereby a blow to said plate member is distributed in said pad through said annular section.

9. The combination of claim 8 wherein said reduced interior standoff section is provided by a hole extending through said cushioning pad to provide a donut ring configuration.

10. In a glove for use in protecting the wearer's hand and having a back surface adapted to fit over the metacarpal portion of the wearer's hand, the combination comprising:

a. a hook and loop fastening material secured to the back surface of the glove over at least a portion of the metacarpal portion of the wearer's hand when the glove is in place;

b. a cushioning pad having an underside surface provided with a hook and loop fastening material mating with the hook and loop fastening material on said glove to releasably secure said pad at its underside surface to the back surface of the glove in a position to cover a portion of the metacarpal portion of the wearer's hand, said cushion being releasably connected to the back surface of said glove in a manner holding the cushion firmly in place on the glove and having an outer hook and loop fastening material on the outer side of said cushioning pad;

c. a rigid protective plate member having on the underside thereof a hook and loop fastening material mating with the hook and loop fastening material on the outer side of said cushioning pad to releasably secure said plate member to the outer side of said cushion pad, said plate member configured to cover a substantial portion of said cushioning pad whereby a sharp blow to the outer surface of said plate member is distributed to a substantial surface area of said cushioning pad and said releasably secured plate member may be positioned independently of the positioning of said cushioning pad to said glove; and d. said rigid plate member having at least one upstanding rib extending transversely of the plate member and being arc-shaped in cross-section and eccentrically positioned on said plate member along the longitudinal dimension thereof.

11. The combination of claim 10, further comprising a second arch-shaped rib member co-extending with and spaced from said upstanding rib.

12. In a protective system for use with a glove having a back surface adapted to fit over the metacarpal portion of the wearer's hand, the combination comprising:

a. a hook and loop fastening material secured to the back surface of the glove over at least a portion of the metacarpal portion of the wearer's hand when the glove is in place;

b. a cushioning pad member having an underside surface provided with a hook and loop fastening material on said glove to releasably secure said pad at its underside surface to the back surface of the glove in a position to cover a portion of the metacarpal portion of the wearer's hand, said cushion being releasably connected to the back surface of said glove in a manner holding the cushion firmly in place on the glove and having an outer hook and loop fastening material on the outer side of said cushioning pad, said cushioning member comprising an interior compressive core material formed of an open cellular foam material having air permeability and a surrounding covering material encapsulating said core material and having air permeability to permit the flow of air from said core material through said covering material;

c. a rigid protective plate member having on the underside thereof a hook and loop fastening material mating with the hook and loop fastening material on the outer side of said cushioning pad to releasably secure said plate member to the outer side of said cushion pad, said plate member comprising a transverse portion having an outwardly curved arc configuration and configured to cover a substantial portion of said cushioning pad whereby a sharp blow to the outer surface of said plate member is distributed to a substantial surface area of said cushioning pad and said releasably secured plate member may be positioned independently of the positioning of said cushioning pad to said glove; and d. said rigid plate member further comprising a downwardly extending lip member adapted to fit around the outer edge of said cushioning pad and the outer edge of said glove when said plate member is in place, on said pad member, said lip member extending downwardly from said transverse portion through a radius of curvature which is less than the average radius of curvature of the transverse portion of said plate member.

13. The combination of claim 12, wherein said plate member has at least one upstanding rib extending transversely of said plate member.

14. The combination of claim 13, wherein said cushioning pad is configured in a manner to provide a reduced interior standoff section and an annular cushioning section surrounding said interior section whereby a blow to the protective plate is distributed in said pad through said annular section.

15. In a protective system for use with a glove having a back surface adapted to fit over the metacarpal portion of the wearer's hand, the combination comprising:

a. a hook and loop fastening material secured to the back surface of the glove over at least a portion of the metacarpal portion of the wearer's hand when the glove is in place;

b. a cushioning pad member having an underside surface and an outer side surface having a convex curvation which is greater than the underside surface, said underside surface being provided with a hook and loop cushioning material mating with the hook and loop cushioning material on said glove when said cushioning pad is in place on said glove and having an outer hook and loop fastening material on the outer side of said cushioning pad, said cushion pad member being configured in a manner to provide a reduced interior standoff section and an annular cushioning section surrounding said interior section whereby a blow to the protective plate is distributed in said pad through said annular section;

c. a rigid protective plate member having a hook and loop fastening material on the underside thereof and adapted to be secured to the outer surface of said pad member, said rigid plate member having a transverse portion outwardly curved arc configuration conforming generally to the convex curvature of said outer surface of said pad member; and d. said rigid plate member further comprising a downwardly extending lip portion adapted to fit around the outer edge of said cushioning pad when said plate member is in place on said pad member.

16. The combination of claim 15, wherein said cushioning pad member comprises an interior compressive core material formed of an open cellular foam material having air permeability and of a surrounding covering material encapsulating said core material and having air permeability to permit the flow of air from said core material through said covering material.

17. The combination of claim 16, wherein said plate member has at least one upstanding rib extending transversely of said plate member.

18. The combination of claim 17, further comprising a second rib member co-extending with and spaced from said upstanding rib.

* * * * *